United States Patent [19]

Buhk

[11] 4,152,023

[45] May 1, 1979

[54] CHAIRS AND METHOD FOR MAKING SAME

[75] Inventor: Randall P. Buhk, Wyoming, Mich.

[73] Assignee: Steelcase Inc., Grand Rapids, Mich.

[21] Appl. No.: 759,387

[22] Filed: Jan. 14, 1977

[51] Int. Cl.[2] ..... A47C 7/02; A47C 7/00

[52] U.S. Cl. ..... 297/452; 297/445; 297/455; 297/92

[58] Field of Search ..... 297/92, 93, 72, 223, 297/283, 229, 130, 445, 458, 455, 460, 421, 411, 449, 452, 441, 440, 452, 455; 248/188.1; 29/91.1, 91.2

[56] References Cited

U.S. PATENT DOCUMENTS

| | | | |
|---|---|---|---|
| 2,907,363 | 9/1975 | Baker et al. | 297/445 |
| 3,055,708 | 9/1962 | Baermann | 297/445 |
| 3,124,390 | 3/1964 | Eames et al. | 297/283 |
| 3,126,229 | 3/1964 | Dickerson | 297/218 X |
| 3,159,428 | 12/1964 | Schier | 297/DIG. 1 |
| 3,174,797 | 3/1965 | Neufeld | 297/218 |
| 3,182,377 | 5/1965 | Hoven et al. | 29/91 UX |
| 3,450,435 | 6/1969 | Stephens | 29/91.1 |
| 3,523,710 | 8/1970 | Barecki et al. | 248/345.1 |
| 3,528,096 | 9/1970 | Moberg | 297/118 X |
| 3,576,059 | 4/1971 | Pearson | 29/91.1 |
| 3,606,461 | 9/1971 | Moriyama | 297/118 |
| 3,722,950 | 3/1973 | Harnick | 297/218 |
| 3,823,980 | 7/1974 | Harnick | 297/218 |
| 3,942,836 | 3/1976 | Baker | 297/445 |
| 3,972,098 | 8/1976 | Morrison et al. | 29/91.2 |
| 4,018,479 | 4/1977 | Ball | 297/DIG. 2 |
| 4,073,539 | 2/1978 | Caruso | 297/455 |

FOREIGN PATENT DOCUMENTS

| | | | |
|---|---|---|---|
| 743780 | 10/1966 | Canada | 297/441 |
| 2264834 | 3/1975 | Fed. Rep. of Germany | 297/DIG. 2 |
| 478298 | 1/1938 | United Kingdom | 297/223 |
| 1030085 | 5/1966 | United Kingdom | 29/91 |

*Primary Examiner*—James T. McCall

*Attorney, Agent, or Firm*—Price, Heneveld, Huizenga & Cooper

[57] ABSTRACT

The specification discloses a chair system wherein two different types of chairs, a shell chair and a sling chair, can be made using the same basic components and tooling. Spaced side rails support a separately molded plastic seat and back which can be upholstered with upholstery pads which do not cover the side rails to create a sling type chair, or which can be upholstered with a wrap-around type of upholstering and covered on the rear surface by a shell when a shell type chair is desired.

35 Claims, 19 Drawing Figures

CHAIRS AND METHOD FOR MAKING SAME

BACKGROUND OF THE INVENTION

The present invention relates to chairs, particularly office furniture chairs. Many types of chairs are sold in the office furniture industry. So called "shell chairs" are characterized by a visible shell of some sort which is three dimensional and curvilinear in configuration, resembling a clam shell or egg shell and encompassing both the seat and back areas of the chair. A sling type chair is characterized by spaced side rails, either visible or readily apparent, which support some type of upholstery slung thereby. Wire rod chairs, characterized by a visible, relatively thin wire rod are also popular. Plastic stacking chairs having plastic seats and back supported on some sort of tubular frame are also sold in the office furniture industry.

A manufacturer of office furniture must offer a variety of different types of chairs such as those discussed above. Unfortunately, it is expensive to offer such alternatives since different components and tooling are required for each line of each different type of chair.

SUMMARY OF THE INVENTION

The present invention makes possible two different lines of two different types of chairs for significantly less than one might expect. A sling type of chair and a shell type of chair can be produced using many common components and common tooling.

The chair system of the present invention employs a pair of spaced side rails mounted on the ends of a stretcher which in turn is mounted on a base, each of the side rails being suitable for finishing whereby they can be exposed if a sling type chair is desired. A formed plastic supporting seat and back means secured at each side to the spaced side rails includes a rear surface which is suitable for exposure to view at least in the back portion, in the event that a sling type chair is desired. A first upholstery and cushion means is shaped and adapted to cover the front surfaces of the supporting seat and back means without covering the side rails at the rear of the seat and back supporting means. By using the above components and the first upholstery and cushion means, a sling type chair can be produced. A second upholstery and cushion means shaped and adapted to cover the front surfaces of the supporting seat and to wrap around to the rear surfaces thereof, generally covering the spaced side rails, is provided if a shell type chair is desired. A molded plastic shell is secured to and covers the rear of the chair, including the spaced side rails and the rear surfaces of the supporting seat and back.

In connection with the present invention, the problem of securing a shell to a shell type chair is also solved in a most expedient and inexpensive manner. In the prior art, nonload bearing trim shells have been secured to load bearing structural shells or their equivalent by screws located at the periphery of the outer shell, the screw heads being covered by a plastic trim member. The present invention eliminates the need to fool with a plastic trim member because the shell includes a groove in the rear surface thereof. The fastener screws for securing the shell to the chair are located down in the groove and the groove is sufficiently deep and narrow that the screws are not readily visible except upon very careful inspection of the chair.

These and other objects, advantages and features of the invention will be more fully understood and appreciated by reference to the written specification and appended drawings.

DESCRIPTION OF THE PREFERRED EMBODIMENT

Figure 1:
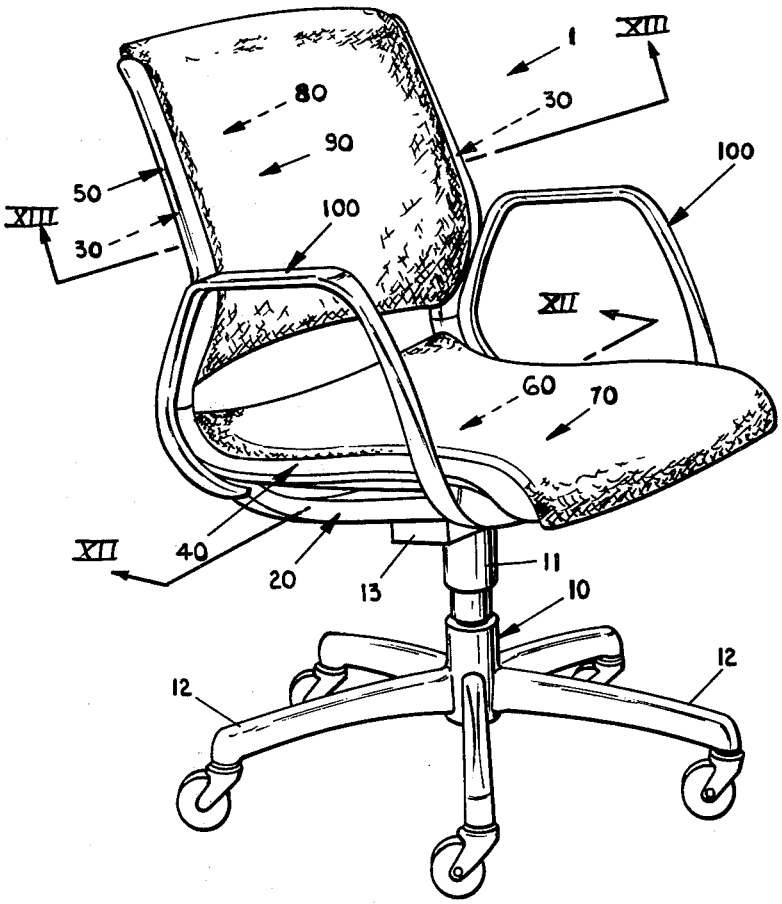
FIG. 1 is a perspective view of a sling type chair made in accordance with the chair system of the present invention.
Figure 2:
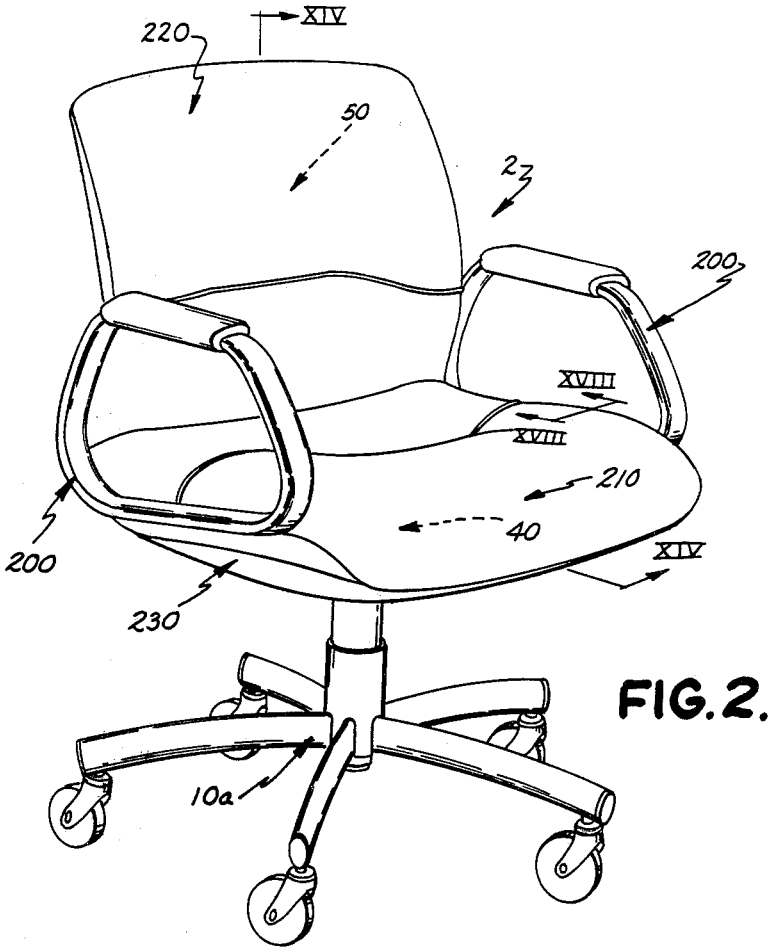
FIG. 2 is a perspective view of a shell type chair made in accordance with the chair system of the present invention.

FIG. 1 shows a preferred embodiment sling type chair while FIG. 2 shows a preferred embodiment shell type chair, both made using the basic system of the present invention. The sling type chair shown in FIG. 1 is so called because it has the characteristic spaced side rails so often seen in such chairs. Technically, the FIG. 1 chair is a marriage of a sling type chair, which usually includes a loose fabric slung between the spaced side rails, and a stacking type of chair in which molded plastic seat and back members are secured to some sort of frame. The sling type chair as shown in FIG. 1 is itself disclosed and claimed in my prior U.S. Pat. No. 3,947,068.

In the present invention, I take advantage of some of the basic components of the chair of my previous invention to create the two chair system of the present invention. Thus, the construction of that chair will again be explained in this patent as it relates to the sling type chair and, as certain of the components relate to the shell chair employed in the chair system of the present invention.

Figure 3:
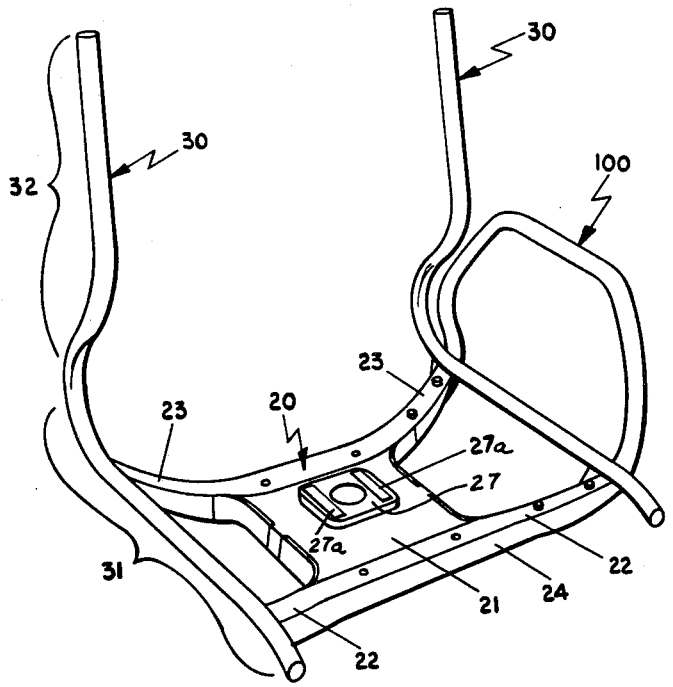
FIG. 3 is a perspective view of the stretcher and spaced side rails employed in the present invention.
Figure 5:
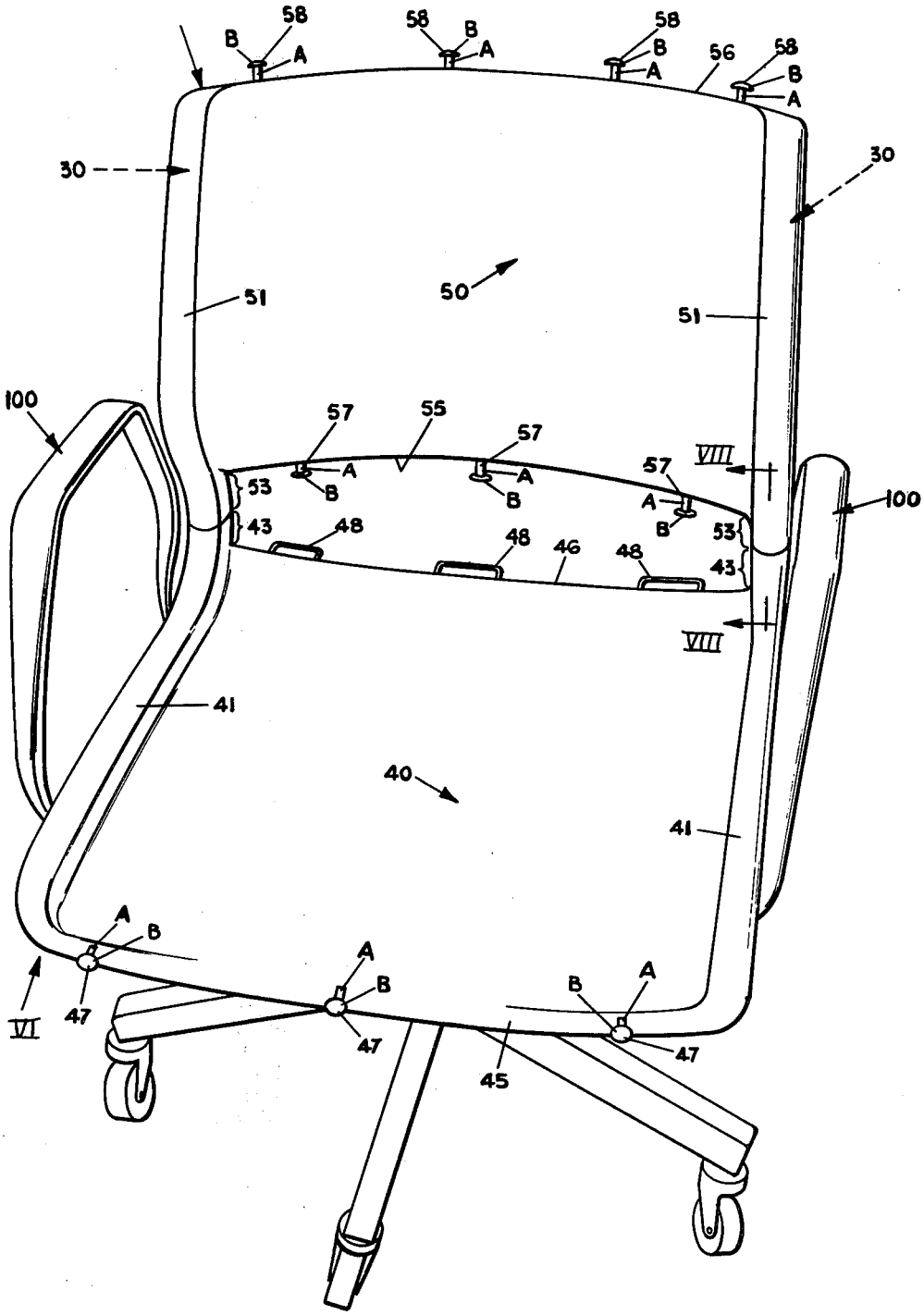
FIG. 5 is a perspective view of the assembled, common components of both the sling and shell type chair of the present invention, with the exception that the particular arms and particular base of the sling type chair are shown.
Figure 7:
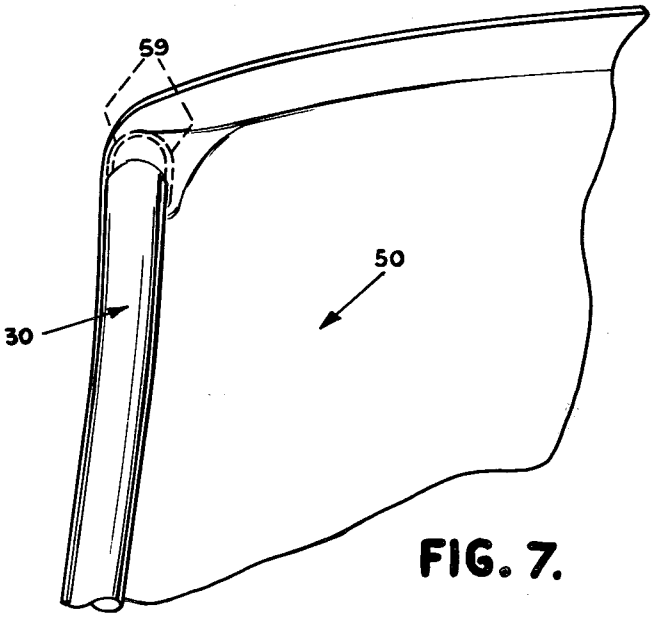
FIG. 7 is a fragmentary view of the upper rear corner of the chair, taken from the rear of the chair, at the point indicated by Arrow VII in FIG. 5.
Figure 6:
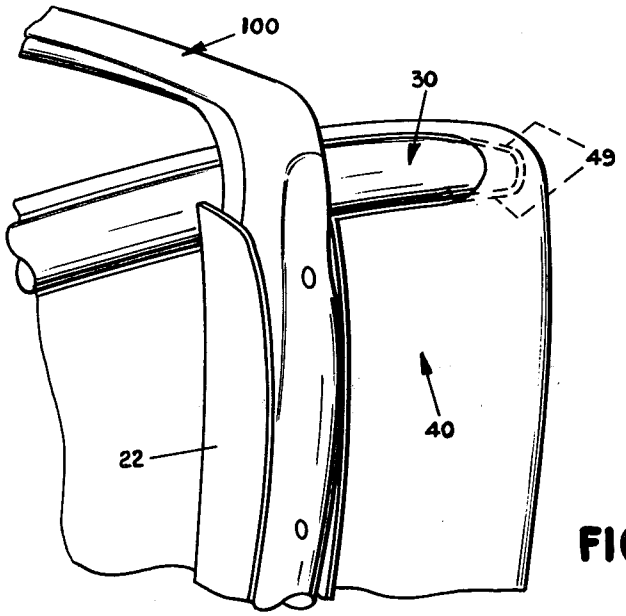
FIG. 6 is a fragmentary view taken at the lower front corner of the chair, from the undersurface thereof, at the corner identified by Arrow VI in FIG. 5.

In the preferred embodiment, both chairs 1 and 2 comprise a stretcher 20 operably mounted on a base 10 for supporting at its ends a pair of spaced side rails (FIG. 3). Secured to side rails 30 are a formed plastic supporting seat 40 and a formed plastic supporting back 50 (FIG. 5) each having at its side edges side channels 41 and 51 respectively which are seated over side rails 30 (FIGS. 5, 6 and 7).

Figure 4:
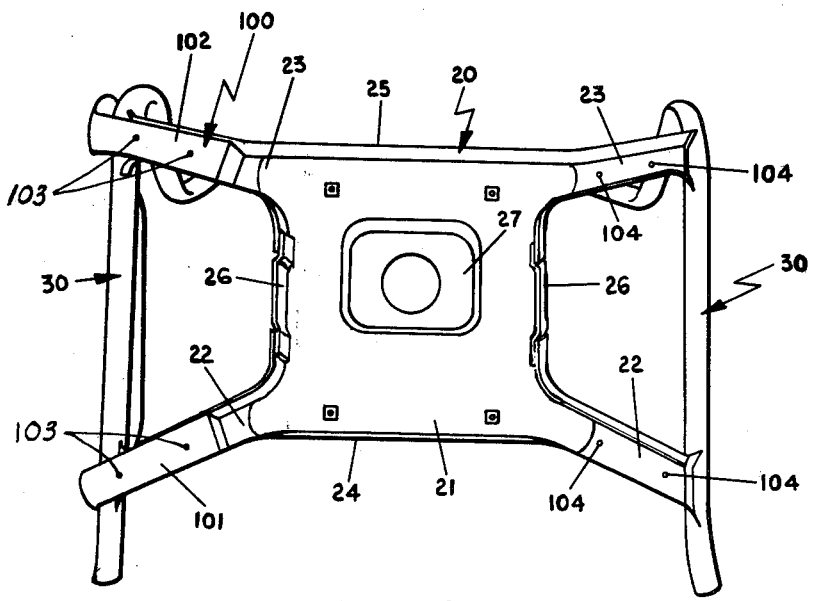
FIG. 4 is a bottom plan view of the stretcher and spaced side rails.
Figure 11:
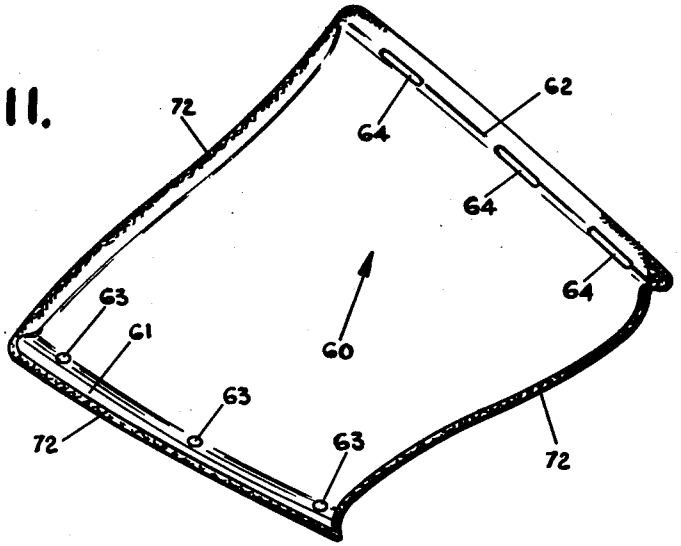
FIG. 11 is a generally bottom perspective view of the upholstered inner seat member of the sling type chair.
Figure 10:
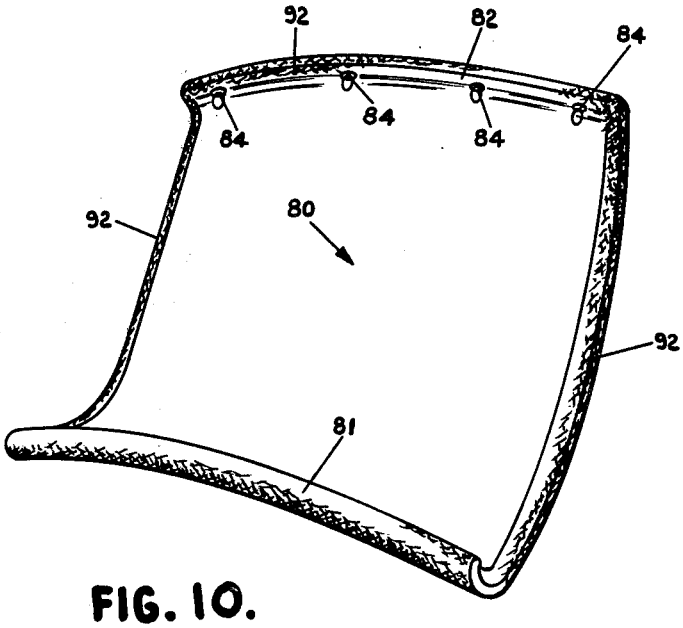
FIG. 10 is a generally rear perspective view of the upholstered inner back member of the sling type chair.
Figure 12:
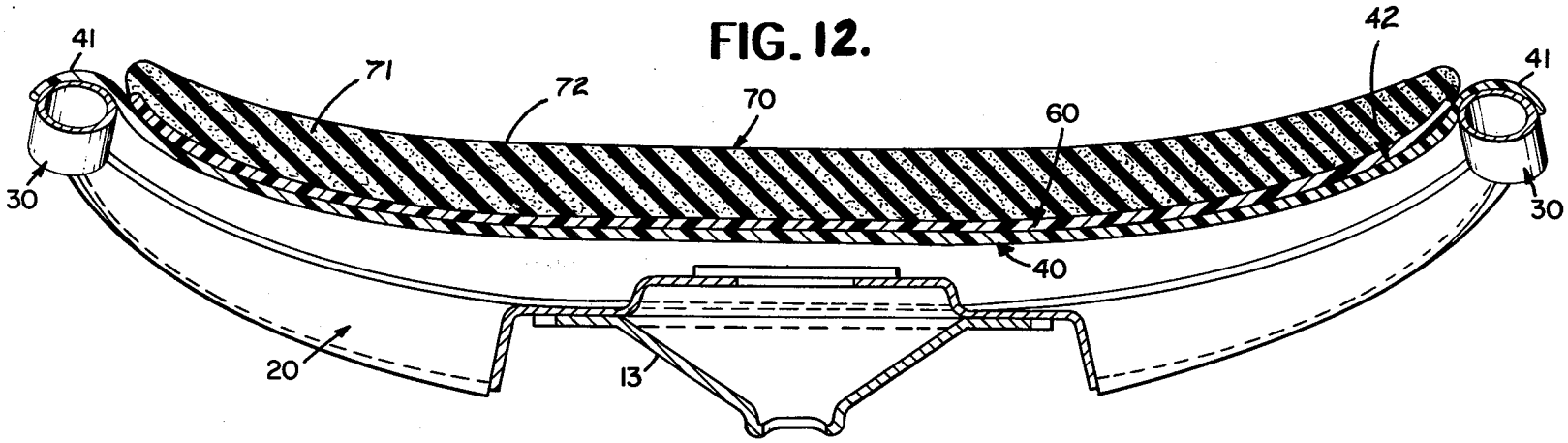
FIG. 12 is a cross sectional view taken along plane XII—XII of FIG. 1.
Figure 13:
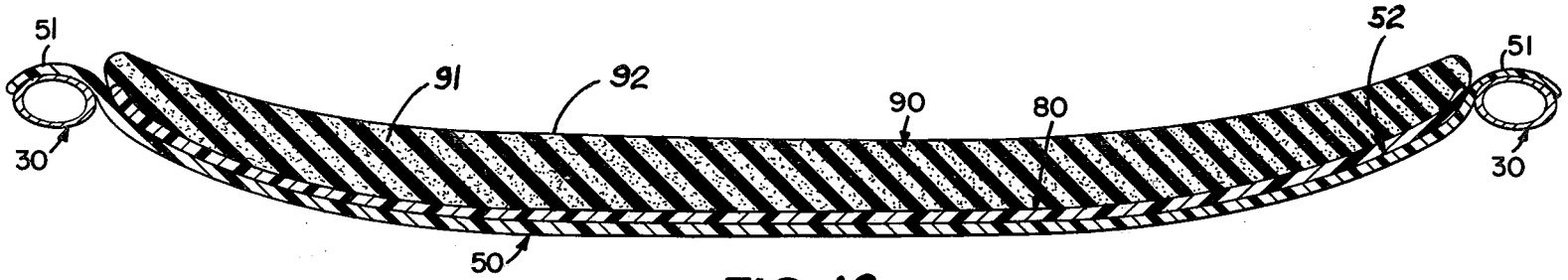
FIG. 13 is a cross sectional view taken along plane XIII—XIII of FIG. 1.

Alternative chair 1 of the system is upholstered and cushioned by upholstered seat and back pads 60 and 80 (FIGS. 1, 10 and 11). Secured to seat 40 is a formed plastic inner seat 60 having a configuration conforming generally to that of supporting seat 40 and being covered by upholstery covering 70 (FIGS. 1, 11 and 12). Secured to back 50 is a formed plastic inner back 80 which is covered by back upholstery covering 90 (FIGS. 1, 10 and 13). The arms 100 of chair 1 may be optionally attached to the chair by securement to stretcher 20 (FIGS. 1 and 4).

Figure 18:
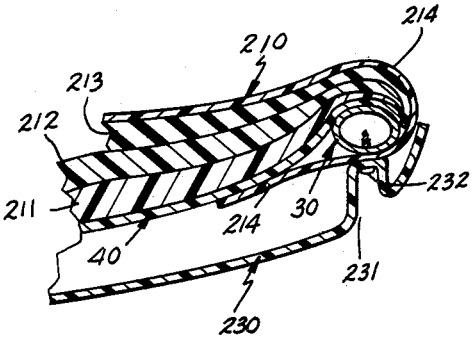
FIG. 18 is a fragmentary cross sectional view taken along plane XVIII—XVIII of FIG. 2.
Figure 17:
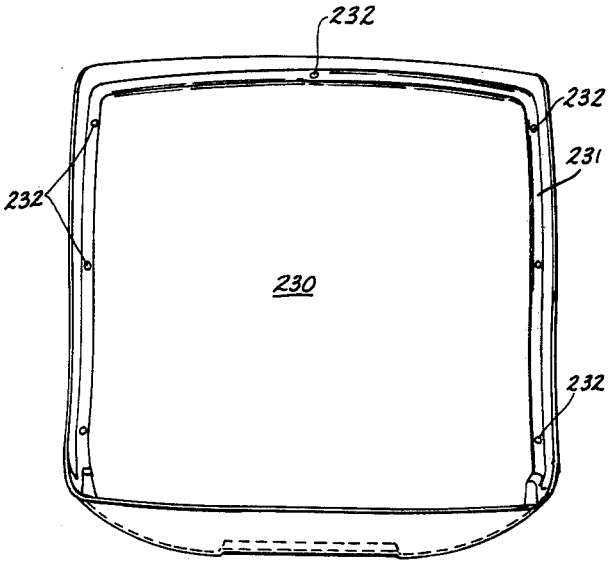
FIG. 17 is a rear elevational view of the shell.

Chair 2 disclosed in FIG. 2 is a shell type chair in which the upholstered inner seat and back members 60 and 80 are eliminated and a different type of upholstery assembly 210 and 220 are employed to upholster and cushion the supporting seat and back members 40 and 50. Basically, cushion members are adhered to the inner seat and back members and an upholstery covering is wrapped around to the rear sides of the supporting seat and back members 40 and 50 so that it covers the spaced side rails 30. Shell 230 is then secured to the rear of the chair by means of fasteners 232 located in the rear of shell 230 (FIGS. 17 and 18).

COMPONENTS COMMON TO BOTH THE SHELL CHAIR AND SLING CHAIR

Base 10 is a pedestal type of base having a post 11 with a plurality of legs 12 projecting outwardly from generally the bottom thereof and with a chair tilter control 13 or other mounting mechanism positioned generally at the top of post 11 (FIG. 1). Stretcher 20 includes an enlarged, generally square shaped central mounting pan 21 to which control 13 is fastened by bolts or like fasteners.

Stretcher 20 is formed of stamped steel. Projecting outwardly from each side of central mounting pan 21 are a front strut 22 and a rear strut 23 (FIGS. 3 and 4). Bent over along the front of stretcher 20 is a front wall 24 which extends downwardly across the front edge of mounting pan 21 and across the leading edge of both front struts 22. Projecting downwardly from the rear edge of stretcher 20 is rear wall 25 which extends along the rear edge of mounting pan 21 and along the rear edges of rear struts 23. In a similar fashion, a side wall 26 extends downwardly and runs along the side edges of mounting pan 21 and extends outwardly along the inside edges of front and rear struts 22 and 23 which face each other. All of these downwardly depending walls 24, 25 and 26 help to hide from view the control 13 of base 10 and its securement to stretcher 20. Also, the downwardly depending walls give added strength to stretcher 20. Finally, in extending along struts 22 and 23, these walls give the struts a generally downwardly opening channel shaped configuration which facilitates the mounting of arms 100 or 200 to the struts 22 and 23 of stretcher 20. Preferably, the front defined by front strut channels 22 and front wall 24 are formed as one piece, the rear defined by rear strut channels 23 and rear wall 25 are formed as one piece and mounting pan 21 is formed as one piece. These three pieces are then welded together to form an integral stretcher 20.

Stretcher 20 also includes an upwardly protruding dome 27 generally in the center of mounting pan 21 which leaves clearance space for the top of control 13 of base 10. Dome 27 also provides a support for supporting seat 40. The distance between the bottom of supporting seat 40 and the top of dome 27 is about 3/8 inch. It is sufficiently small distance that when a person sits on the chair, supporting seat 40 comes to rest on the top of dome 27 before sufficient stress is put on channels 41 to cause them to unwrap from or, in other words, be pulled off of side rails 30. In essence, dome 27 serves as a support so that at least some of the load imposed on the chair is transmitted directly axially downwardly onto dome 27 and from thence to the column 11 of base 10.

The side rails 30 which are welded to the ends of struts 22 and 23 are tubular steel members bent to define a seat supporting portion 31 and a back supporting portion 32 (FIG. 3). They can be bent into any of a number of different configurations to give the sling type chair 1 a particular aesthetic or ornamental appearance.

Supporting seat 40 is formed by injection molding of a polypropylene copolymer (approximately 13% polyethylene). Other plastics and other forming methods can be used. Seat 40 should be quite rigid, having a thickness of approximately 5/32 inch. When supported on side rails 30, supporting seat 40 serves to support a person seated in the chair. While the shape of supporting seat 40 is to some extent dictated by comfort considerations, the ornamental designer does have some leeway and can affect the design theme of chair 1 by varying the shape to be given seat 40, particularly at the front, rear and side edge portions. Of course, such changes have no significant bearing in the appearance of shell chair 2.

The channels 41 which are formed at each side of seat 40 are raised generally with respect to the rest of seat 40 so as to define a well 42 between the spaced channels 41 (FIG. 12). It is not essential that the entire surface of seat 40 be below the level of the tops of channel 41 (it will be noticed that seat 40 raises somewhat towards the middle) but it is preferable that there be a well-like depression at least in the area adjacent the side channels 41. In this manner, when the upholstered inner seat 60 is secured to supporting seat 40, its edges will be positioned fairly closely adjacent the inside wall of the raised channels 41 and it will be more difficult to get underneath the seat upholstery pad 60 and pry it upwardly. This is not imperative with respect to shell chair 2.

At the underside of seat 40, at each front corner of seat 40, each side channel 41 terminates in a recessed pocket 49 into which the forward end of side rail 30 extends (FIG. 6). This not only serves to hide the end of side rail 30, but also serves to secure supporting seat 40 in place at the front of the chair.

Back 50 is formed by injection molding of a polypropylene copolymer (approximately 13% polyethylene). Other plastics and other forming methods can be used. Back 50 should be quite rigid, having a thickness of approximately 5/32 inch. When supported on side rails 30, supporting back 50 serves to support a person leaning back in the chair. As with seat 40, the shape of supporting back 50 is to some extent controlled by comfort considerations. However, the designer has some leeway for purely ornamental considerations, particularly along the top, bottom and side portions. The channels 51 are formed at each side of back 50 so as to define a well 52 between the spaced channels 51 (FIG. 13). It is not essential that the entire surface of back 50 be below the level of the tops of channel 51, but it is preferable that there be a well-like depression at least in the area adjacent the side channels 51. In this manner, when the upholstered inner back 80 is secured to supporting back 50, its edges will be positioned fairly closely adjacent the inside wall of the raised channels 51 and it will be more difficult to get underneath the back upholstery pad 80 and pry it upwardly. Again, this is important only with respect to sling type chair 1, not shell chair 2.

At the backside of back 50, at each top corner of back 50, each side channel 51 terminates in a recessed pocket 59 into which the upper end of side rail 30 extends (FIG. 7). This not only serves to hide the end of side rail 30, but also serves to secure back 50 in place at the back of the chair.

Figure 8:
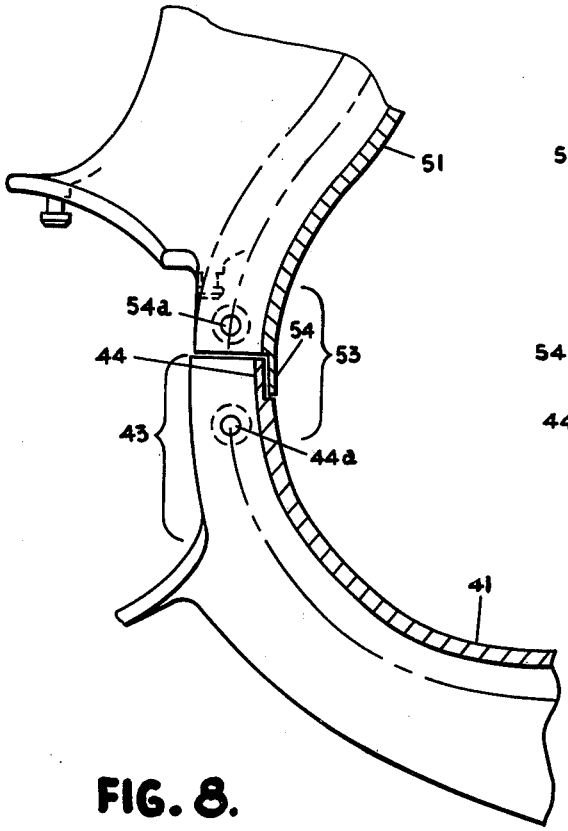
FIG. 8 is a fragmentary cross sectional view taken along plane VIII—VIII of FIG. 5.
Figure 9:
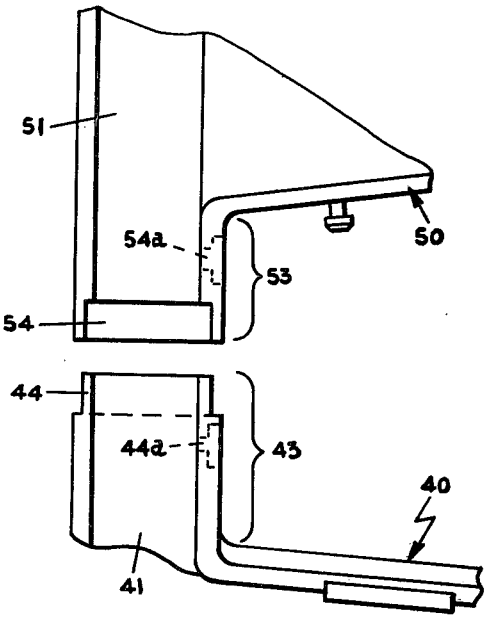
FIG. 9 is a rear elevational view of the juncture of the supporting seat and back of the chair at the area shown in FIG. 8.

The side channels 41 of seat 40 include projecting portions or seat channel projections 43 which project rearwardly and upwardly from the rear edge of seat 40 towards back 50 (FIGS. 5 and 9). Similarly, the side channels 51 of back 50 include projecting portions or back channel projections 53 which project downwardly from the bottom of back 50 towards seat 40. Channel projection 43 terminates in a channel shaped flange 44 while channel projection 53 terminates in a channel shaped overlying flap 54. Flap 54 overlaps flange 44 so that the side channels 41 and 51 meet in such a way as to align channel projections 53 and 43 and to define a continuous, smooth flowing surface with only a slight line being visible at the junction. Once flap 54 is seated over flange 44, a screw is passed through a screw hole 54*a* in the inside of channel projection 53 (FIGS. 8 and 9), above flap 54, and is threaded into underlying side rail 30. Similarly, a screw is passed through screw hole 44*a* in the inside of channel projection 43 and is threaded into underlying side rail 30. This positively locks supporting seat 40 and supporting back 50 in place at their rear and bottom respectively so that once the ends of side rails 30 are in place in the pockets 49 and 59 of seat 40 and back 50 respectively and once the projecting side channel portions 43 and 53 are in their proper overlapping condition and secured by screws through holes 54*a* and 44*a*, the back 50 and seat 40 are firmly secured to side rails 30.

THE SLING TYPE CHAIR

The first type of upholstery and cushioning used in the system comprises an upholstered inner seat 60 and an upholstered inner back 80. This first system is employed in the sling type chair.

Inner seat 60 is preferably injection molded of basically the same plastic of which supporting seat 40 and supporting back 50 are made and has a thickness of approximately ⅛ inch. It should have sufficient thickness and rigidity that it will hold its shape when secured to supporting seat 40 and such that it will not be bent out of shape when it is covered with upholstery covering 70. It is molded to have a configuration conforming generally to the configuration of the inside of supporting seat 40 within well 42 (FIGS. 11 and 12). Inner seat 60 is approximately as wide as the distance between the inwardly facing walls of side channels 41 of supporting seat 40.

For securing inner seat 60 to supporting seat 40, seat 40 is rolled over along its front edge 45 and includes three integrally molded buttons 47 projecting from its front edge 45 at spaced intervals therealong (FIG. 5). Projecting from the rear edge 46 of seat 40 are three spaced integrally molded tabs 48. In a somewhat similar manner, four integrally molded buttons 58 project upwardly at spaced intervals from the rolled over top edge 56 of back 50 and three integrally molded buttons 57 project downwardly from the rolled over bottom edge 55 of back 50. These integrally molded projecting buttons and tabs facilitate securement of the upholstered inner seat 60 and inner back 80 to seat 40 and back 50 respectively. Inner seat 60 is rolled over along its front edge to define a front lip 61 and it is turned sharply over along its rear edge to define a rear lip 62. Front lip 61 includes three spaced holes 63 therein, whose positions correspond generally to the front projecting buttons 47 of seat 40. In this manner, inner seat 60 is secured along the front edge of supporting seat 40 by snapping the enlarged heads of projecting buttons 47 through the holes 63 of inner seat 60. Rear lip 62 includes three spaced slots 64 (FIG. 11) spaced at intervals corresponding to the spacing of tabs 48, and each having a length corresponding approximately to the width of a tab 48, so that the rear of inner seat 60 is secured in place by snapping rear lip 62 over the rear edge 46 of supporting seat 40 with tabs 48 projecting into slots 64.

Inner back 80 is similarly molded of basically the same plastic of which supporting seat 40 and supporting back 50 are molded and has a thickness of approximately ⅛ inch. As with inner seat 60, inner back 80 must have sufficient thickness and rigidity to hold its shape during the covering process and to hold its shape when secured to supporting back 50. Inner back 80 is molded to have a configuration corresponding generally to the configuration of the front surface of supporting back 50 in the area of the well 52 of back 50 (FIGS. 10 and 13). Inner back 80 is approximately as wide as the distance between the inwardly facing walls of side channels 51 of supporting back 50. Inner back 80 includes a rolled over bottom lip 81 and a rolled over top lip 82 which fit over the bottom edge 55 and top edge 56 of back 50 respectively. Top lip 82 includes four spaced holes 84 therein which receive the four spaced top projecting buttons 58 of back 50 and bottom lip 81 includes three spaced bottom holes which are spaced to correspond to buttons 57 and into which snap the heads of bottom buttons 57. The bottom holes are formed in a manner similar to holes 84.

Inner seat 60 is covered with an upholstery covering composite 70 which includes a layer of cushioning material 71 and suitable upholstery material 72 (FIGS. 11 and 12). The cushioning material is adhered to the top surface of inner seat 60 with a suitable adhesive. Similarly, the upholstery 72 is adhered to the cushioning material 71 by suitable adhesive. Additionally, the upholstery 72 is wrapped around all of the edges of inner seat 60 and is attached by adhesive or possibly by other fastening means along the upholstery edges to the rear surface of inner seat 60. FIG. 11, which is a view of inner seat 60 from the underside, is helpful in illustrating the manner in which the upholstery 72 is wrapped around the edges of inner seat 60 and adhered to the rear undersurface thereof.

Back upholstery covering composite 90 is similar and includes a layer of cushioning material 91 which is adhered to the front surface of inner back 80 and a layer of upholstery 92 which covers cushioning 91 (FIG. 13). Upholstery 92 is wrapped around all of the edges of inner back 80 and is attached to the rear surface thereof as above. FIG. 10 is a generally rear perspective view of inner back 80 and shows the manner in which upholstery 92 is wrapped over its edges and adhered to the rear surface thereof.

Arms 100 of the present chair are an optional attachment (FIGS. 3 and 4). Each arm 100 is a bar of metal such as cast aluminum, formed sheet steel, or the like which is generally U-shaped in configuration and which includes a forward end portion 101 and a rear end portion 102 which project inwardly toward the center of the chair, out of the generally vertical plane of the remainder of the generally U-shaped arm 100. The forward projecting end portion 101 fits snugly into the channel defined by front strut 22 of stretcher 20 and the rear end portion 102 fits snugly into the channel defined by rear strut 23. Each end portion includes a pair of spaced threaded bolt holes 103 therein whereby a suitable bolt fastening can be used to secure the end portions 101 and 102 to their respective struts 22 and 23. It will be noted that matching holes 104 are provided in all of the struts to facilitate passing of the bolts through the struts.

In assembly, the inner seat 60 and inner back 80 are covered with cushioning 71 and 91 respectively and upholstery 72 and 92 respectively in the manner indicated above. Arms 100 may be added optionally to the struts of stretcher 20. The supporting seat 40 and supporting back 50 are then secured to the side rails 30 in the manner indicated above and the covered inner seat and inner back are secured to the supporting seat and supporting back respectively in the manner indicated above. The completed assembly is then secured to base 10.

THE SHELL TYPE CHAIR

Figure 14:
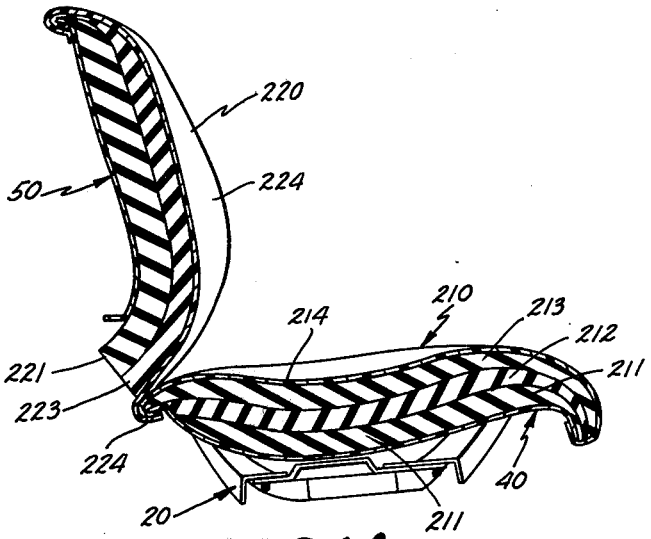
FIG. 14 is a cross sectional view of the upper portion of the shell type chair without the shell attached, taken along plane XIV—XIV of FIG. 2.

The second type of upholstery and cushioning employed in the system of the present invention comprises a seat upholstery and cushion assembly 210 and a back upholstery and cushion assembly 220 (FIG. 14). An urethane foam pad 211 of relatively firm density is glued directly to supporting seat 40. Glued to it is a less dense material 212 and laying on top of it is a top pad 213 which is approximately the same density as layer 212, but which lies loosely on top of layer 212 whereas layer 212 itself is glued to the bottom pad 211. All of this generally conventional cushioning is in turn covered with an upholstery layer 214 which is wrapped around the edges of supporting seat 40 and is stapled, glued or both to the rear surface of supporting seat 40 as shown in both FIGS. 14 and 15. It will be noted by reference to FIG. 15 and FIG. 18 that the spaced side rails 30 are completely covered by the upholstery material 214.

In a similar manner, the upholstery and cushion assembly 220 which covers supporting back 50 includes a bottom pad or cushion 221 of relatively firm density which is loosely covered by a less dense pad 223. The bottom edges of these upholstery pads are simply allowed to project through the space between supporting seat 40 and supporting back 50. An upholstery covering 224 covers these pads and is wrapped around the top and side edges of supporting back 50 and is glued and/or stapled to the rear of supporting back 50 in such a way that the spaced side rails 30 are covered.

Figure 15:
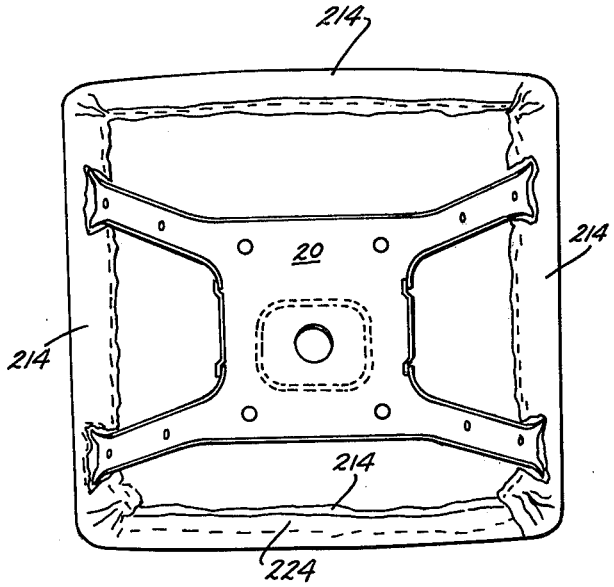
FIG. 15 is a bottom plan view of that portion of the shell type chair shown in FIG. 14.

The bottom edge of upholstery material 224 is pulled down through the opening between supporting seat 40 and supporting back 50 and is wrapped around and stapled or glued to the underside of supporting seat 40 along its rear edge (FIGS. 14 and 15). It is actually lapped over the top of the rear edge of upholstery covering 214. In this way, the supporting seat 40 and back 50 are covered in a continuous manner as though they were a single unit, and no space shows between the two in the finally assembled chair. This is in contrast to the sling type chair where a space between the upholstered supporting seat 40 and back 50 is clearly visible and is part of the design.

One advantage to having the space between the supporting seat and back is the ability to easily pull the bottom of covering 224 through the space and secure it to the rear edge of supporting seat 40, thereby creating a neat tuck or seam appearance at the juncture of the seat and back of the shell type chair. Another advantage is that while the lumbar region is clearly supported by the supporting back 50, the rear of the buttocks of a person seated in the shell type chair are more softly received and supported by that portion of the back cushion assembly which projects through the space between supporting seat 40 and back 50, thereby providing a softer comfort in that area of the body.

Figure 16:
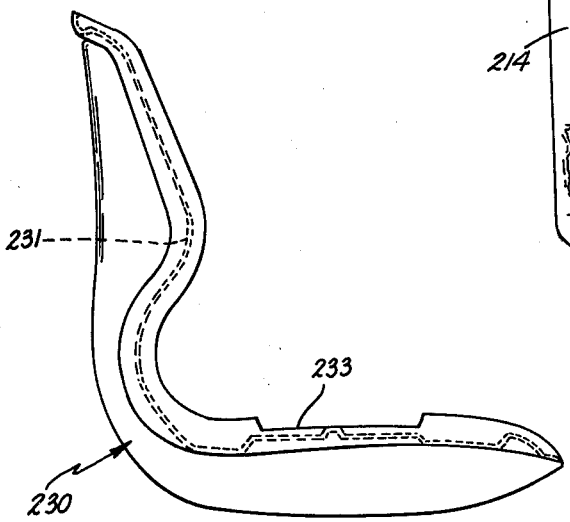
FIG. 16 is a side elevational view of the shell of the shell type chair.
Figure 19:
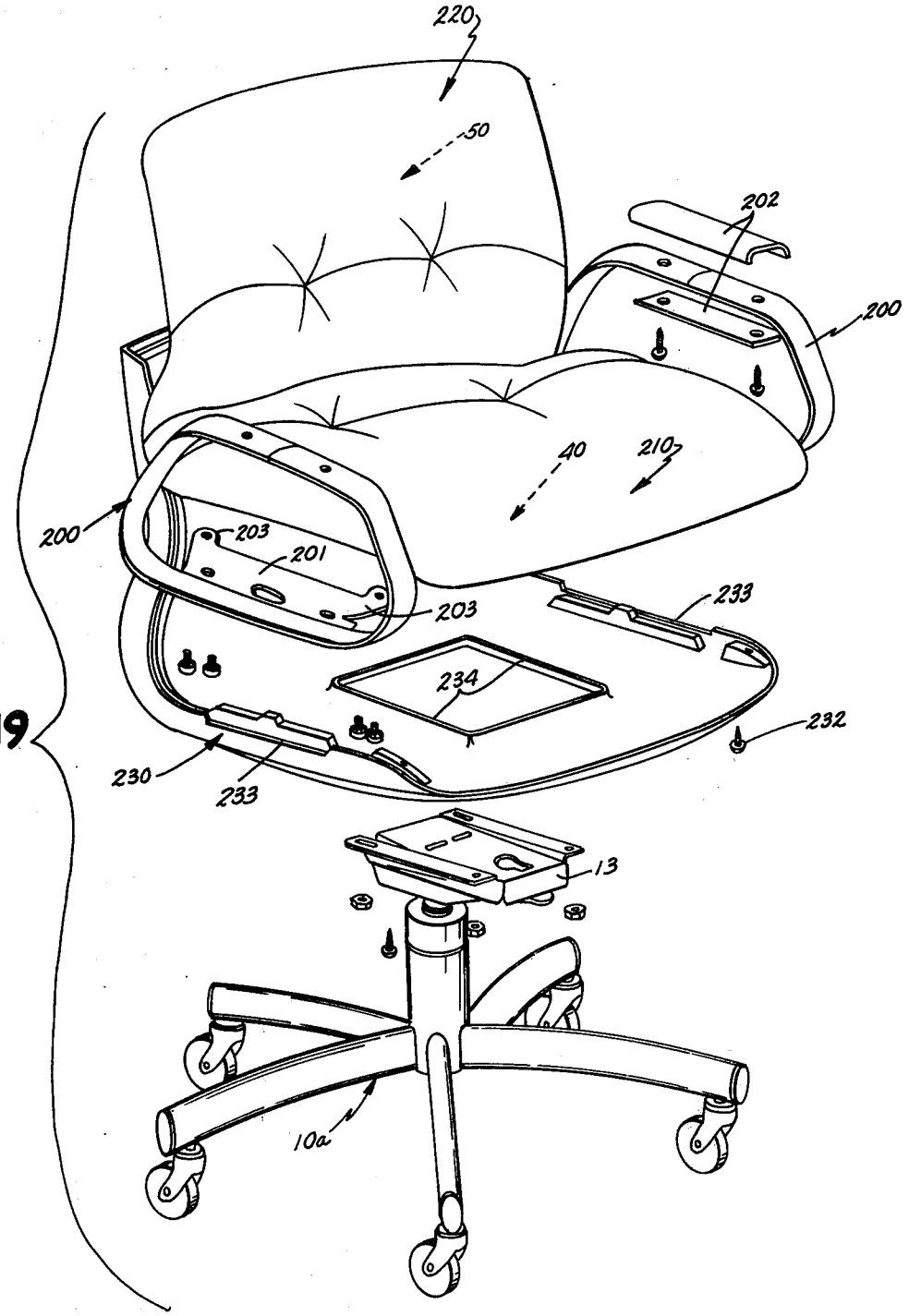
FIG. 19 is an exploded perspective view of the various components employed in the shell type chair of the system of the present invention.

Shell 230 is a molded plastic shell with integral seat and back covering portions (FIGS. 16, 17 and 19). It is molded of a material such as polypropylene, polyethylene or the like of a softer, more flexible grade so that it will give or yield slightly when it comes into contact with an article of furniture.

Molded into shell 230 is a groove 231 which opens to the rear and bottom of the chair. It extends generally along the top and side edges of the shell, spaced a short distance in from the edge of the shell. The depth of groove 231 is approximately $\frac{3}{4}$ inch, although at some points it is shallower, particularly at the points where the arms are to be secured to the chair, along the side of the seat covering portion of shell 230 (FIGS. 16 and 19). Groove 231 is also relatively narrow, approximately $\frac{1}{4}$ inch, although it is slightly wider at the top than at the bottom to facilitate withdrawal of shell 230 from the mold. Because of the depth and narrowness, it serves to conceal from casual view the small fastener screws 232 which are used to secure shell 230 to the rest of the chair 2.

Specifically, shell chair 2 is assembled by first assembling the basic components shown in FIG. 5 (excluding arms 100 and base 10). The upholstery and cushion assemblies 220 and 210 are then secured to supporting back 50 and supporting seat 40 as explained above. Shell 230 is then located to the rear of the assembly shown in FIG. 14 and is secured to spaced side rails 30 by means of fastening screws 232 (FIGS. 18 and 19). The screws 232 are located within groove 231 at various points along the seat and back portions of spaced side rails 232. For good measure, one or two fastening screws 232 may be located in that portion of groove 231 which runs along the upper back of the chair, with the fastening screws 232 extending into inner supporting back 50. A similar arrangement could be employed along the front of the seat, although it is not necessary. In fact, no groove 231 is provided along the front edge of shell 230 in the preferred embodiment.

An alternative set of arms 200 may also be secured to shell type chair 2. In assembly, the alternative arms 200 would be secured prior to securing shell 230. Arms 100 could be used if the outer shell was modified to provide greater clearance in notch 233 (FIGS. 16 and 19), but the use of the alternative arm 200 adds further variety to the two different lines of chairs. Arm 200 is an oval type arm with a flange 201 including inwardly projecting mounting portions 203 which bolt within the channels defined by the struts 22 and 23 of stretcher 20, just as the ends of arms 100 fit into and are bolted to struts 22 and 23 (see FIGS. 4 and 6). The inwardly protruding groove 231 is reduced or eliminated and shell 230 is notched slightly at 233 to accommodate the passage of flange 201 and projections or mounting portions 203 through shell 230 and into the receiving channels defined by struts 22 and 23. A suitable arm cap assembly 202 is also provided as a further decoration.

Just as arms 200 are different from arms 100 employed in the sling type chair, so too a different base **10*a* can also be employed in the shell type chair (FIG. 19). Once shell 230 is assembled to the chair, the entire assembly can be secured to base 10*a*. A suitable aperture 234 is provided in the bottom of shell 230 to allow the passage of the upper pan of chair control 13 of base 10*a* through shell 230 and to facilitate its securance to stretcher assembly 20**.

CONCLUSION

As a result of the system of the present invention, a manufacturer can offer two completely different types of chairs, shell and sling, using some common components and common tooling. While I have specifically employed a sling type chair made in accordance with my earlier invention, U.S. Pat. No. 3,947,068, and while I have designed a particular shell type chair as part of the system, it will be apparent to those skilled in the art that various changes and alterations can be made to both the sling chair design employed and the shell chair design employed without departing from the spirit and broader aspects of the invention as set forth in the appended claims.

The embodiments of the invention in which an exclusive property or privilege is claimed are defined as follows:

1. A chair system, in which two different types of chairs can be produced using common components, comprising;

said common components including a base; a stretcher operably mounted on said base and having one end at one side of said chair and another end at the other side of said chair; a pair of spaced side rails, one joined to said one end of said stretcher and the other joined to said other end of said stretcher, each said side rail being continuous and having a seat supporting portion and a back supporting portion and being suitable for finishing; formed plastic supporting seat and back means secured at each side to said spaced side rails and having a rear surface at least in the back portion thereof which is suitable for exposure to view if a sling type chair is desired;

said system further including first upholstery and cushion means shaped and adapted to cover the front surfaces of said supporting seat and back means without covering said side rails at the rear of said seat and back supporting means if a sling type chair is desired; second upholstery and cushioning means shaped and adapted to cover the front surfaces of said supporting seat and back means and for wrapping around and securing to the rear surface of said supporting seat and back means, generally covering said spaced side rails, if a shell type chair is desired; a molded, plastic shell being adapted for securing to and covering the rear of the chair, including said spaced side rails and said rear surfaces of said supporting seat and back means, for providing a shell type chair;

said supporting seat and back being covered by one of said first upholstery and cushioning means and a combination of said second upholstery and cushioning means and said molded plastic shell; said spaced side rails being finished when said supporting seat and back are covered by said first upholstery and cushioning means.

2. The chair system of claim 1 in which said first upholstery and cushion means comprises formed plastic inner seat and back means having a shape conforming generally to the front surface of said supporting seat and back means and cushioning and upholstery covering the face of said inner seat and back means, said upholstery including portions wrapped around the edges of said inner seat and back means to the rear surface thereof and being secured thereto; means securing said inner seat and back means to said supporting seat and back means when a sling type chair is desired; said second upholstery and cushioning means comprising cushions adhered directly to said supporting seat and back means and upholstery covering said cushions and being wrapped around to the rear surfaces of said supporting seat and back means for creating a shell type chair.

3. The chair system of claim 2 in which said supporting seat and back means comprise a separate seat and a separate back member with a visible space therebetween; said first upholstery covering means comprising means for separately covering said supporting seat and said supporting back such that said space therebetween is clearly visible when a sling type chair is produced; said second upholstery and cushioning means being adapted to fill in and cover said space between said supporting seat and supporting back means so as to render said space invisible when a shell type chair is created.

4. The chair system of claim 1 in which said second upholstery and cushioning means comprises cushioning covering said supporting back and extending downwardly into the space between said supporting seat and back; back upholstery being wrapped around the top and side edges of said supporting back and including a downwardly extending portion extending down behind the rear edge of said supporting seat and being wrapped around and secured along the bottom surface of said supporting seat along its rear edge.

5. The chair system of claim 4 in which said second upholstery and cushion means includes cushioning secured to said supporting seat and said upholstery covering said cushioning and being wrapped around the front, side and rear edges of said supporting seat and being secured to the rear surface of said supporting seat; said downwardly extending back upholstery being secured to the undersurface of said supporting seat along its rear edge on top of that portion of said seat upholstery which wraps around and is secured to the undersurface of said supporting seat along its rear edge.

6. The chair system of claim 5 which includes first and second sets of arms of two different types, one set of arms being secured to said chair when a sling type chair is desired and the other set of arms being secured to said chair when a shell type chair is desired.

7. The chair system of claim 6 in which said stretcher comprises forward and rear struts extending outwardly towards each side of said chair, each of said forward and rear struts comprising a downwardly opening channel; each of said first and second types of arms including inwardly projecting mounting portions adapted to fit within and be secured to said receiving channels of said forward and rear struts of said stretcher.

8. The chair system of claim 7 in which said chair shell includes a narrow, inwardly projecting groove in its rear surface, which groove is visible in the assembled chair; fasteners being located in said groove and said groove being sufficiently deep and narrow that said fasteners are generally not visible except upon close inspection; said fasteners securing said shell to the rear of said chair when a shell chair is desired.

9. The chair system of claim 8 in which said groove comprises a groove located in alignment with each of said spaced side rails whereby said fasteners extend into said spaced side rails and secure said shell to said spaced side rails.

10. The chair system of claim 1 in which said supporting seat and back means comprise a separate seat and a separate back member with a visible space therebetween; said first upholstery covering means comprising means for separately covering said supporting seat and said supporting back such that said space therebetween is clearly visible when a sling type chair is produced; said second upholstery and cushioning means being adapted to fill in and cover said space between said supporting seat and supporting back means so as to render said space invisible when a shell type chair is created.

11. The chair system of claim 1 which includes first and second sets of arms of two different types, one set of arms being secured to said chair when a sling type chair is desired and the other set of arms being secured to said chair when a shell type chair is desired.

12. The chair system of claim 11 in which said stretcher comprises forward and rear struts extending outwardly towards each side of said chair, each of said forward and rear struts comprising a downwardly opening channel; each of said first and second types of arms including inwardly projecting mounting portions adapted to fit within and be secured to said receiving channels of said forward and rear struts of said stretcher.

13. The chair system of claim 1 in which said chair shell includes a narrow, inwardly projecting groove in its rear surface, which groove is visible in the assembled chair; fasteners being located in said groove and said groove being sufficiently deep and narrow that said fasteners are generally not visible except upon close inspection; said fasteners securing said shell to the rear of said chair when a shell chair is desired.

14. The chair system of claim 13 in which said groove comprises a groove located in alignment with each of said spaced side rails whereby said fasteners extend into said spaced side rails and secure said shell to said spaced side rails.

15. A shell chair comprising: a supporting seat and a separate supporting back mounted on a frame and being spaced from one another whereby there is a space between said supporting seat and said supporting back; said cushioning adhered to the upper surface of said supporting seat; back cushioning secured to the front surface of said supporting back and extending downwardly into and generally through the opening between said supporting seat and said supporting back; seat upholstery covering said seat cushioning and said supporting seat and being wrapped around and secured to the rear surfaces of said supporting seat along the front, side and rear edges thereof; back upholstery covering said back cushioning and said supporting back and being wrapped around the top and side edges of said supporting back and being secured to the rear surface of said supporting back along said rear top and side edges; said back upholstery extending downwardly through said opening between said supporting seat and said supporting back and being wrapped around and secured to the rear surface of said supporting seat along said rear edge thereof, over said seat upholstery located along said rear edge; a shell secured to said chair, said shell covering the rear surfaces of said supporting seat and back, covering said frame and covering the portions of said seat and back upholstery which are wrapped around to the rear surfaces of said supporting seat and back and said shell covering those portions of said back cushioning which extend into said opening between said supporting seat and back.

16. A shell type chair including an inner member defining a seat and a back; an outer shell covering the rear and undersurfaces of said seat and back of said inner member; said shell including at least one narrow groove extending inwardly towards said inner member, the base of said groove making contact with at least portions of said inner member; said groove being visible when said chair is viewed from the rear; fasteners being located in said groove and securing said shell to said inner member, said groove being sufficiently deep and narrow that said fasteners are not readily visible on casual viewing of the chair and can be seen only by more careful inspection of said groove in said shell.

17. The shell chair of claim 16 in which one of said grooves is located at least at either side of said shell in the back portions thereof.

18. The shell chair of claim 17 in which said inner member is a body supporting member capable of supporting the weight of a person seated in said chair in normal usage, said outer shell being a decorative, nonload bearing trim member secured to said inner member and being spaced therefrom over most of its area, with the exception at least of portions of said groove which come into contact with said inner member to facilitate securance of said outer shell to said inner member.

19. The shell chair of claim 18 in which said inner member comprises seat and back members secured to a frame, said fasteners which are located in said grooves extending into said frame to thereby secure said shell to said inner member.

20. A method for producing two different types of chairs, a sling type chair and a shell type chair, using at least some common components, said method comprising the following steps not necessarily in the sequence indicated:

providing first and second chair subassemblies, each having the following substantially identical components: a stretcher having one end at one side of the particular chair to be produced and another end at the other side of the particular chair to be produced, a pair of spaced side rails, one joined to said one end of said stretcher and the other joined to said other end of said stretcher, each said side rail being continuous and having a seat supporting portion and a back supporting portion and being suitable for finishing whereby each said side rail can be finished and exposed if a sling type chair is desired; formed plastic supporting seat and back means secured at each side to said spaced side rails and having a rear surface at least in the back portion thereof which is suitable for exposure to view if a sling type chair is desired;

finishing the spaced side rails in said first chair subassembly; securing first upholstery and cushion means to said supporting seat and back means of said first subassembly such that they cover the front surfaces of said supporting seat and back means without covering said side rails at the rear of said supporting seat and back means; and securing the resulting subassembly to a base to thereby produce a sling type chair based on said first chair subassembly;

securing second upholstery and cushioning means to said second chair subassembly to cover the front surfaces of said supporting seat and back means, and wrapping the upholstery of said upholstery and cushion means around the edges of said supporting seat and back means and over the rear of said spaced side rails and securing said upholstery to the rear surfaces of said supporting seat and back means; placing a molded plastic shell having seat and back covering portions over the rear of said second chair subassembly to cover said spaced side rails, the rear surfaces of said supporting seat and back means and the upholstery which is wrapped around to the rear surfaces of said supporting seat and back means; and placing the resulting subassembly on a base to thereby create a shell type chair out of said second chair subassembly.

21. The method of claim 20 in which said step of securing said first upholstery and cushion means to said supporting seat and back means of said first chair subassembly comprises: forming a plastic inner seat and back means having a shape conforming generally to the front surface of said supporting seat and back means; and covering said inner seat and back means with cushioning and upholstering, wrapping said upholstery around the edges of said inner seat and back means and securing it at its edges to the rear surfaces of said inner seat and back means; followed by securing said inner seat and back means as thus upholstered to said supporting seat and back means; and wherein said step of securing second upholstery and cushion means to said second chair subassembly comprises securing cushions directly to said supporting seat and back means and covering said cushions with upholstery, wrapping said upholstery around to the rear surfaces of said supporting seat and back means and securing said upholstery to said rear surfaces.

22. The method of claim 21 in which said step of providing said first and second subassemblies with their respective supporting seat and back means comprises providing a separate seat and a separate back member for each said subassembly with a visible space therebetween; said step of securing first upholstery and cushion means to said first subassembly comprising separately covering said supporting seat and said supporting back such that said space therebetween is clearly visible in the completed sling type chair; said step of securing second upholstery and cushioning means to said second chair subassembly comprising filling said space between said supporting seat and back means with cushioning and covering said cushioning and said space with upholstery so as to render said space invisible in the shell type chair.

23. The method of claim 22 in which said step of securing said second upholstery and cushioning means to said second chair subassembly comprises covering said supporting back with cushioning which extends downwardly into the space between said supporting seat and back and wrapping back upholstery over said cushioning and around the top and side edges of said supporting back, and carrying said back upholstery downwardly into the space between said supporting seat and back and behind the rear edge of said supporting seat, and wrapping said back upholstery around the rear edge of said supporting seat and securing said back upholstery to the bottom surface of said supporting seat along its rear edge.

24. The method of claim 23 in which said step of securing said second upholstery and cushion means to said second chair subassembly includes securing cushioning to said supporting seat and covering said cushioning and supporting seat with seat upholstery covering, wrapping said seat upholstery around the front, side and rear edges of said supporting seat and securing it to the rear surfaces of said supporting seat; said step of carrying said back upholstery downwardly and securing it to the undersurface of said supporting seat along its rear edge comprises securing said back upholstery on top of that portion of said seat upholstery which wraps around and is secured to the undersurface of said supporting seat along its rear edge.

25. The method of claim 24 which includes the step of providing first and second sets of arms of two different types, one set of arms being secured to said first chair subassembly and the other set of arms being secured to said second chair subassembly.

26. The method of claim 25 in which said step of providing said first and second chair subassemblies with said stretcher comprises providing a stretcher with forward and rear struts extending outwardly towards each side of said chair, each of said forward and rear struts comprising a downwardly opening channel; said step of providing said first and second types of arms including providing said arms with inwardly projecting mounting portions adapted to fit within and be secured to said receiving channels of said forward and rear struts of said stretcher.

27. The method of claim 26 in which said step of placing a molded plastic shell on said second chair subassembly includes providing said shell with a narrow, inwardly projecting groove in its rear surface, which groove is visible in the assembled chair; locating fasteners in said groove and securing said shell to the rear of said second chair subassembly, and providing said groove with sufficient depth and rendering said groove sufficiently narrow that said fasteners are generally not visible except upon close inspection.

28. The method of claim 27 in which said step of providing a groove in said shell comprises locating a groove in alignment with each of said spaced side rails, whereby said fasteners extend into said spaced side rails and secure said shell to said spaced side rails of said second chair subassembly.

29. The method of claim 20 in which said step of providing said first and second subassemblies with their respective supporting seat and back means comprises providing a separate seat and a separate back member for each said subassembly with a visible space therebetween; said step of securing first upholstery and cushion means to said first subassembly comprising separately covering said supporting seat and said supporting back such that said space therebetween is clearly visible in the completed sling type chair; said step of securing second upholstery and cushioning means to said second chair subassembly comprising filling said space between said supporting seat and back means with cushioning and covering said cushioning and said space with upholstery so as to render said space invisible in the shell type chair.

30. The method of claim 29 in which said step of securing said second upholstery and cushioning means to said second chair subassembly comprises covering said supporting back with cushioning which extends downwardly into the space between said supporting seat and back and wrapping back upholstery over said cushioning and around the top and side edges of said supporting back, and carrying said back upholstery downwardly into the space between said supporting seat and back and behind the rear edge of said supporting seat, and wrapping said back upholstery around the rear edge of said supporting seat and securing said back upholstery to the bottom surface of said supporting seat along its rear edge.

31. The method of claim 30 in which said step of securing said second upholstery and cushion means to said second chair subassembly includes securing cushioning to said supporting seat and covering said cushioning and supporting seat with seat upholstery covering, wrapping said seat upholstery around the front, side and rear edges of said supporting seat and securing it to the rear surfaces of said supporting seat; said step of carrying said back upholstery downwardly and securing it to the undersurface of said supporting seat along its rear edge comprises securing said back upholstery on top of that portion of said seat upholstery which wraps around and is secured to the undersurface of said supporting seat along its rear edge.

32. The method of claim 20 which includes the step of providing first and second sets of arms of two different types, one set of arms being secured to said first chair subassembly and the other set of arms being secured to said second chair subassembly.

33. The method of claim 32 in which said step of providing said first and second chair subassemblies with said stretcher comprises providing a stretcher with forward and rear struts extending outwardly towards each side of said chair, each of said forward and rear struts comprising a downwardly opening channel; said step of providing said first and second types of arms including providing said arms with inwardly projecting mounting portions adapted to fit within and be secured to said receiving channels of said forward and rear struts of said stretcher.

34. The method of claim 20 in which said step of placing a molded plastic shell on said second chair subassembly includes providing said shell with a narrow, inwardly projecting groove in its rear surface, which groove is visible in the assembled chair; locating fasteners in said groove and securing said shell to the rear of said second chair subassembly, and providing said groove with sufficient depth and rendering said groove sufficiently narrow that said fasteners are generally not visible except upon close inspection.

35. The method of claim 34 in which said step of providing a groove in said shell comprises locating a groove in alignment with each of said spaced side rails, whereby said fasteners extend into said spaced side rails and secure said shell to said spaced side rails of said second chair subassembly.

* * * * *

UNITED STATES PATENT AND TRADEMARK OFFICE

CERTIFICATE OF CORRECTION

PATENT NO. : 4,152,023

DATED : May 1, 1979

INVENTOR(S) : Randall P. Buhk

It is certified that error appears in the above-identified patent and that said Letters Patent are hereby corrected as shown below:

Column 9, line 52:
After "comprising" delete ";" and insert ---:---

Column 10, line 62:
"said" (second occurrence) should be ---seat---

Column 12, line 5:
"said" (first occurrence) should be ---seat---

Signed and Sealed this

*Sixteenth* Day of *October 1979*

[SEAL]

*Attest:*

RUTH C. MASON
*Attesting Officer*

LUTRELLE F. PARKER
*Acting Commissioner of Patents and Trademarks*